US006223557B1

(12) United States Patent
Cole

(10) Patent No.: US 6,223,557 B1
(45) Date of Patent: May 1, 2001

(54) PROCESS FOR REMOVING A VOLATILE COMPONENT FROM NATURAL GAS

(75) Inventor: Eric T. Cole, Kingwood, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/422,668

(22) Filed: Oct. 21, 1999

Related U.S. Application Data

(60) Provisional application No. 60/105,283, filed on Oct. 22, 1998.

(51) Int. Cl.[7] ..... F25B 1/00
(52) U.S. Cl. ..... 62/613; 62/619; 62/48.2
(58) Field of Search ..... 62/613, 617, 619, 62/48.2

(56) References Cited

U.S. PATENT DOCUMENTS

| | | | |
|---|---|---|---|
| 2,916,888 | 12/1959 | Cobb . | |
| 3,298,805 | 1/1967 | Secord et al. | 48/190 |
| 3,596,472 | 8/1971 | Streich | 62/28 |

(List continued on next page.)

OTHER PUBLICATIONS

Bennett, C. P. Marine Transportation of LNG at Intermediate Ttemperature, *CME*(Mar. 1979), pp. 63–64.

Faridany, E. K., Secord, H.C, O'Brien, J. V., Pritchard, J. F., and Banister, M. The Ocean Phoenix Pressure–LNG System, *GASTECH*76 (1976), New York, pp. 267–280.

Faridany, E. K., Ffooks R. C., and Meikle, R. B. A Pressure LNG System, European Offshore Petroleum Conference & Exhibition (Oct. 21–24, 1980), vol. EUR 171, pp. 245–254.

Broeker, R. J. CNG and MLG–New Natural Gas Transportation Processes, *American Gas Journal*(Jul. 1969) pp. 138–140.

Fluggen, Prof. E. and Backhaus, Dr. I. H. Pressurised LNG – and the Utilisation of Small Gas Fields, Gastech78, LNG/LPG Conference (Nov. 7, 1978), Monte Carlo pp. 195–204.

Broeker, R. J. A New Process for the Transportation of Natural Gas, Proceedings of the First International Conference on LNG (1968), Chicago, Illinois, Session No. 5, Paper 30, pp. 1–11.

Ladkany, S. G. Composite Aluminum–Fiberglass Epoxy Pressure Vessels for Transportation of LNG at Intermediate Temperature, published in *Advances in Cryogenic Engineering, Materials,* vol. 28, (Proceedings of the 4th International Cryogenic Materials Conference), San Diego, CA, USA, Aug. 10–14, 1981, pp. 905–913.

*Primary Examiner*—Ronald Capossela
(74) *Attorney, Agent, or Firm*—Gary D. Lawson

(57) ABSTRACT

A process is disclosed to remove at least one high volatility component, such as nitrogen, from a pressurized natural gas to produce pressurized liquefied natural gas that is lean in nitrogen and has a temperature above about −112° C. (−170° F.). A pressurized feed natural gas containing nitrogen is expanded and passed to a fractionation column. The fractionation column produces a first vapor stream that has enhanced nitrogen content and a first liquid stream. The vapor stream is cooled to produce a vapor phase and a liquid phase. The vapor and liquid phases are then phase separated to produce a second vapor stream and a second liquid stream. The second liquid stream is returned to the fractionation column as reflux. The second vapor stream is preferably used to cool the incoming feed stream. The first liquid stream is removed from the fractionation system as a product stream lean in nitrogen.

9 Claims, 1 Drawing Sheet

U.S. PATENT DOCUMENTS

| | | | |
|---|---|---|---|
| 3,797,261 | 3/1974 | Juncker et al. | 62/40 |
| 3,830,180 | 8/1974 | Bolton | 114/74 A |
| 3,874,184 | 4/1975 | Harper et al. | 62/28 |
| 4,017,283 | 4/1977 | Witt | 62/40 |
| 4,172,711 | 10/1979 | Bailey | 62/21 |
| 4,225,329 | 9/1980 | Bailey et al | 62/24 |
| 4,230,469 | 10/1980 | Grimm et al. | 62/28 |
| 4,411,677 | 10/1983 | Pervier et al. | 62/25 |
| 4,451,275 | 5/1984 | Vines et al. | 62/28 |
| 4,504,295 | 3/1985 | Davis et al. | 62/30 |
| 4,592,767 | 6/1986 | Pahade et al. | 62/31 |
| 4,662,919 | 5/1987 | Davis | 62/25 |
| 4,664,686 | 5/1987 | Pahade et al. | 62/24 |
| 4,675,037 | 6/1987 | Newton | 62/28 |
| 4,732,598 | 3/1988 | Rowles et al. | 62/28 |
| 4,805,413 | 2/1989 | Mitchell et al. | 62/24 |
| 4,970,867 | 11/1990 | Herron et al. | 62/11 |
| 5,036,671 | 8/1991 | Nelson et al. | 62/23 |
| 5,051,120 | 9/1991 | Pahade et al. | 62/24 |
| 5,120,338 | 6/1992 | Potts et al. | 62/12 |
| 5,257,505 | 11/1993 | Butts | 62/24 |
| 5,375,422 | 12/1994 | Butts | 62/24 |
| 5,414,190 | 5/1995 | Förg et al. | 585/802 |
| 5,421,165 | 6/1995 | Paradowski et al. | 62/24 |
| 5,505,049 | 4/1996 | Coyle et al. | 62/11 |
| 5,524,456 * | 6/1996 | Stokes | 62/48.2 |
| 5,537,827 | 7/1996 | Low et al. | 62/613 |
| 5,540,059 * | 7/1996 | Yokokawa | 62/48.2 |
| 5,588,306 | 12/1996 | Schmidt | 62/614 |
| 5,611,216 | 3/1997 | Low et al. | 62/612 |
| 5,802,871 | 9/1998 | Howard et al. | 62/627 |
| 5,829,269 * | 11/1998 | Pecoud et al. | 62/48.2 |
| 5,878,814 | 3/1999 | Breivik et al. | 166/267 |
| 5,893,274 | 4/1999 | Nagelvoort et al. | 62/613 |
| 5,950,453 | 9/1999 | Bowen et al. | 62/612 |
| 5,956,971 | 9/1999 | Cole et al. | 62/623 |

* cited by examiner

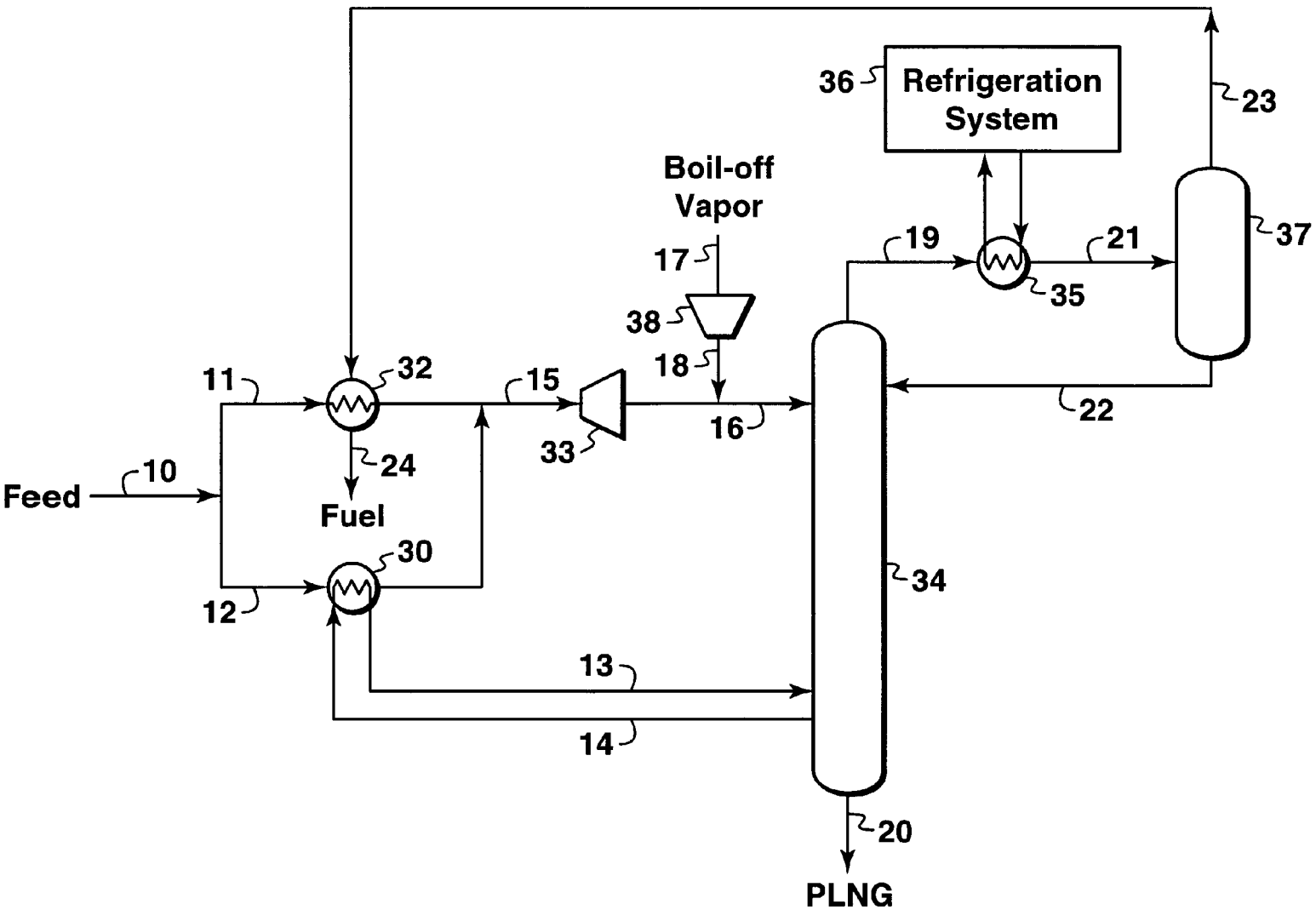
Refrigeration System
Boil-off Vapor
Fuel
PLNG
Feed
10
11
12
13
14
15
16
17
18
19
20
21
22
23
24
30
32
33
34
35
36
37
38

PROCESS FOR REMOVING A VOLATILE COMPONENT FROM NATURAL GAS

This application claims the benefit of U.S. Provisional Application No. 60/105,283, filed Oct. 22, 1998.

FIELD OF THE INVENTION

This invention relates generally to a process for liquefying a multi-component feed stream using cryogenic fractionation. More specifically, the invention relates to a process to liquefy a natural gas stream containing a component more volatile than methane to produce pressurized liquefied natural gas (PLNG) that is lean in the more volatile component.

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

Natural gas often contains diluent gases such as nitrogen and helium. The presence of these gases reduces the heating value of the natural gas. Also, certain of these gases may have independent commercial uses if they can be separated from the natural gas. Consequently, the separation of diluent gases from natural gas may have twofold economic benefit, namely, enhancement of the natural gas heating value and production of a marketable gas such as helium. LNG plants also remove the nitrogen from the natural gas because the nitrogen will not remain in the liquid phase during transport of conventional LNG, which is at or near atmospheric pressure.

In general, most known natural gas separation processes comprise at least three distinct operative steps or stages. These include (1) a preliminary gas treatment step for the removal of water and acidic gases such as carbon dioxide and hydrogen sulfide, (2) a natural gas liquids product separation step using low but non-cryogenic temperatures for the separation and recovery of the ethane and heavier hydrocarbon components, and (3) a nitrogen separation or rejection step, often referred to as Nitrogen Rejection Units (NRUs). The nitrogen rejection is generally effected by the cooling of the nitrogen-containing natural gas and fractionating it in a distillation column.

It has recently been proposed to produce methane-rich liquid having a temperature above about −112° C. (−170° F.) and a pressure sufficient for the liquid to be at or below its bubble point. This pressurized liquid natural gas is sometimes referred to as PLNG to distinguish it from LNG which is at or near atmospheric pressure. The pressure of PLNG will typically be above about 1,380 kPa (200 psia). One of the advantages of a process for producing PLNG is that pressurized liquefied natural gas can contain up to about 10 mole percent nitrogen. However, the nitrogen lowers the heating value of the PLNG and increases the bubble point of the PLNG product. There is therefore a need for an improved process for removing nitrogen from a pressurized natural gas stream and simultaneously producing PLNG.

SUMMARY

The invention relates generally to a separation process in which a pressurized feed stream containing methane and at least one high volatility component, such as helium and nitrogen, that has a relative volatility greater than that of methane. For illustrative purposes, it will be assumed that the primary separation is between $N_2$ and $CH_4$.

In the preferred embodiment of this invention, a process is disclosed for separating nitrogen from a nitrogen-containing, pressurized natural gas to produce a pressurized liquid natural gas that is lean in nitrogen and having a temperature above about −112° C. (−170° F.). The pressurized natural gas feed stream is passed to a fractionation column at a pressure above about 1,380 kPa (250 psia). The pressure of the feed natural gas is preferably above about 4,137 kPa (600 psia) and it is expanded by a suitable expansion means to a lower pressure prior to being passed to the fractionation column. The fractionation column produces a first liquid stream that is lean in nitrogen and a first vapor stream that has enhanced nitrogen content. The vapor stream is then cooled to produce a vapor phase and a liquid phase. The vapor and liquid phases are then phase separated to produce a second vapor stream and a second liquid stream. The second liquid stream is returned to the fractionation column as reflux. The second vapor stream is preferably used to cool the incoming feed stream. The first liquid is removed from the fractionation system as a product stream lean in nitrogen and having a temperature above about −112° C. (−170° F.) and a pressure sufficient for the liquid product to be at or below its bubble point.

Optionally, the feed stream is separated into a first feed stream and a second feed stream. The first feed stream is cooled by indirect heat exchange with a process-derived stream from a fractionation column. The second feed stream is cooled by indirect heat exchange with a process-derived liquid from the fractionation column. The first and the second feed streams are then combined and passed to the fractionation column.

One advantage of the present invention is that pressurized liquid product can be produced that is lean in nitrogen with only one fractionation column without having to reduce to fractionation column to need atmospheric pressure which is the conventional practice for removing nitrogen from liquefied natural gas.

BRIEF DESCRIPTION OF THE DRAWING

The present invention and its advantages will be better understood by referring to the following detailed description and the attached drawing which is a schematic flow diagram of one embodiment of this invention. The drawing is not intended to exclude from the scope of the invention other embodiments which are the result of normal and expected modifications of the embodiment disclosed in the drawing. Various required subsystems such as valves, flow stream mixers, control systems, and sensors have been deleted from the drawing for the purposes of simplicity and clarity of presentation.

DESCRIPTION OF THE PREFERRED EMBODIMENTS

It has been discovered that a pressurized natural gas stream containing methane and a relatively volatile component such as nitrogen can be cryogenically separated with only minimal need for auxiliary cryogenic refrigeration to produce a pressurized liquefied natural gas that is substantially free of nitrogen without reducing the pressure to near atmospheric pressure.

In accordance with this discovery, the present invention provides a process for separation of pressurized liquefied natural gas containing methane and at least one high volatility component, such as helium and nitrogen. The separation process produces a pressurized liquid natural gas that is substantially free of the high volatility component and that has a temperature above about −112° C. (−170° F.) and a pressure sufficient for the liquid product to be at or below its bubble point. This methane-rich product is sometimes referred to in this description as pressurized liquid natural gas ("PLNG").

The term "bubble point" as used in this description is the temperature and pressure at which a liquid begins to convert to gas. For example, if a certain volume of PLNG is held at constant pressure, but its temperature is increased, the temperature at which bubbles of gas begin to form in the PLNG is the bubble point. Similarly, if a certain volume of PLNG is held at constant temperature but the pressure is reduced, the pressure at which gas begins to form defines the bubble point. At the bubble point, the liquefied gas is saturated liquid.

The first consideration in cryogenic processing of natural gas is contamination. The raw natural gas feed stock suitable for the process of this invention may comprise natural gas obtained from a crude oil well (associated gas) or from a gas well (non-associated gas). The composition of natural gas can vary significantly. As used herein, a natural gas stream contains methane ($C_1$) as a major component. The natural gas will typically also contain ethane ($C_2$), higher hydrocarbons ($C_{3+}$), and minor amounts of contaminants such as water, carbon dioxide, hydrogen sulfide, nitrogen, butane, hydrocarbons of six or more carbon atoms, dirt, iron sulfide, wax, and crude oil. The solubilities of these contaminants vary with temperature, pressure, and composition. At cryogenic temperatures, $CO_2$, water, or other contaminants can form solids, which can plug flow passages in cryogenic heat exchangers. These potential difficulties can be avoided by removing such contaminants if temperatures equal to or below their pure component, solid temperature-pressure relationship is anticipated. In the following description of the invention, it is assumed that the natural gas stream has been suitably treated to remove sulfides and carbon dioxide and dried to remove water using conventional and well-known processes to produce a "sweet, dry" natural gas stream. If the natural gas stream contains heavy hydrocarbons that could freeze out during liquefaction or if the heavy hydrocarbons are not desired in the PLNG, the heavy hydrocarbons may be removed by a fractionation process prior to producing the PLNG. At the operating pressures and temperatures of PLNG, moderate amounts of nitrogen in the natural gas can be tolerated since the nitrogen will remain in the liquid phase with the PLNG. In this description, it is assumed that the natural gas contains nitrogen at levels high enough to justify nitrogen removal in accordance with the separation process of this invention. In this description of the invention, the nitrogen content of the feed stream preferably ranges between about 1 mole % and about 15 mole %.

Referring to the drawing, natural gas feed stream 10 enters the liquefaction process and is preferably split into two streams 11 and 12. Stream 12 is cooled by heat exchanger 30 through which circulates cold liquid from separation column 34.

Stream 11 flows through heat exchanger 32 which is in indirect heat exchange relationship with overhead vapors from phase separator 37. The term "indirect heat exchange," as used in this description and claims, means the bringing of two fluid streams into heat exchange relation without any physical contact or intermixing of the fluids with each other. Streams 11 and 12 are combined and the combined stream (stream 15) is passed through a suitable expansion means 33, such as a conventional turboexpander, to lower the pressure and thereby cool the vapor stream prior to entry into separation column 34 at an intermediate level.

In the embodiment of this invention depicted in the drawing, the pressure of the natural gas in feed stream 10 is above about 4,137 kPa (600 psia) and preferably above about 4,827 kPa (700 psia) and preferably at temperatures below 40° C.; however, different pressures and temperatures can be used, if desired, and the system can be appropriately modified accordingly. If the feed stream 10 is below about 4,137 kPa (600 psia), it can be pressurized by a suitable compression means (not shown), which may comprise one or more compressors. It should be understood, however, that expander 33 is not an essential component of the invention. If the pressure of feed stream 10 is lower than 4,137 kPa (600 psia) and is at or near the pressure desired for the pressure of product stream 20, the feed stream 10 can be fed to the fractionation column 34 without passing through an expansion means 33.

Column 34 is a typical distillation tower containing trays and/or packing that provides the necessary contact between liquids falling downward and vapors rising upward. Separation column preferably operates at pressures ranging from about 1,380 kPa (200 psia) to about 4,137 kPa (600 psia). Separation column 34 separates a vapor stream 19 enriched in nitrogen and a liquid stream 20 enriched in methane. The liquid stream 20 leaves the separation column at a temperature above about −112° C. and a pressure sufficient for the liquid to be at or below its bubble point. The liquid is then sent to a suitable containment vessel such as a stationary storage tank or a carrier such as a PLNG ship, truck, or railcar.

Vapor stream 19 exiting the top of nitrogen rejection fractionation system 34 contains methane, nitrogen, and other light components such as helium and hydrogen. Vapor stream 19 passes through heat exchanger 35 which is cooled by a closed-cycle refrigeration system 36. This invention is not limited to any type of heat exchanger, but because of economics, plate-fin, spiral wound, and cold box heat exchangers are preferred, which all cool by indirect heat exchange. The refrigeration system 36 can be any conventional closed-loop refrigeration system suitable for condensing a substantial portion of the vapor stream 19. The refrigeration system may contain one or more of the following: propane, propylene, ethane, ethylene, carbon dioxide, methane, nitrogen or any other suitable refrigerant. Refrigeration system 36 is preferably a closed-loop multi-component refrigeration system which is a well known means of cooling by indirect heat exchange to persons having ordinary skill in the art. The cooled stream exiting the heat exchanger 35 is passed to a phase separator 37 which produces and overhead vapor stream 23 enriched in nitrogen and a liquid stream 22 that is refluxed to the separation column 34. Vapor stream 23 is passed through heat exchanger 32 to cool feed stream 11 and to extract refrigeration from the vapor stream 23. After exiting the heat exchanger 32, the vapor stream is available for use as fuel gas for turbines that drive process compressors and pumps or the vapor stream may be further processed to recover sales quality nitrogen and/or helium.

In the storage, transportation, and handling of liquefied natural gas, there can be a considerable amount of "boil-off." The process of this invention may optionally re-liquefy such boil-off vapors and also remove nitrogen contained in the boil-off vapor. The primary source of nitrogen impurity in the boil-off vapor is that which is contained in the liquefied natural gas that is the source of the boil-off vapors. Nitrogen, more volatile than liquefied natural gas, flashes off preferentially and concentrates within the boil-off vapor. For example, liquefied natural gas containing 0.3 mole percent $N_2$ can produce a vapor containing approximately 3 mole percent $N_2$. At the higher temperatures and pressure of PLNG, the nitrogen flashes off even more preferentially than conventional liquefied natural gas at or near atmospheric pressure.

Referring to the drawing, boil-off vapor may be introduced to the process of the invention through stream 17. Although the drawing illustrates introducing the boil-off vapor stream 17 to the process stream at a point between expander 33 and fractionation column 34, it will be apparent to those skilled in the art in light of the teachings of this invention, that the boil-off vapor may be introduced at any point in the process before the feed stream is introduced into column 34 and it may also be introduced directly to the column 34. The boil-off vapor introduced to the separation process of this invention should be at or near the pressure of the stream to which the boil-off vapor is introduced. Depending on the pressure of the boil-off vapor, the boil-off vapor may need to be pressure adjusted by a compressor to increase its pressure or expanded to reduce its pressure to be at or near the pressure of the stream to which the boil-off vapor enters.

EXAMPLE

A simulated mass and energy balance was carried out to illustrate the embodiment illustrated in the drawing, and the results are set forth in the Table below. The data presented in the Table are offered to provide a better understanding of the embodiment shown in the drawing, but the invention is not to be construed as unnecessarily limited thereto. The temperatures and flow rates are not to be considered as limitations upon the invention which can have many variations in temperatures and flow rates in view of the teachings herein.

The data were obtained using a commercially available process simulation program called HYSYS™ (available from Hyprotech Ltd. of Calgary, Canada); however, other commercially available process simulation programs can be used to develop the data, including for example HYSIM™, PROII™, and ASPEN PLUS™, which are familiar to those of ordinary skill in the art.

This example illustrates an advantage of the present invention in producing a reduced-nitrogen PLNG in a single column without lowering the pressure of the process to near atmospheric pressure which is typically the practice in conventional nitrogen rejection units.

A person skilled in the art, particularly one having the benefit of the teachings of this patent, will recognize many modifications and variations to the specific processes disclosed above. For example, a variety of temperatures and pressures may be used in accordance with the invention, depending on the overall design of the system and the composition of the feed gas. Also, the feed gas cooling train may be supplemented or reconfigured depending on the overall design requirements to achieve optimum and efficient heat exchange requirements. As discussed above, the specifically disclosed embodiments and examples should not be used to limit or restrict the scope of the invention, which is to be determined by the claims below and their equivalents.

TABLE 1

| Stream | Phase Liquid/ Vapor | Pressure psia | Pressure kPa | Temp ° F. | Temp ° C. | Flow lb mole/hr | Flow kg mole/hr | Composition, mole % $C_1$ | $C_2$ | $C_{3+}$ | $CO_2$ | He | $N_2$ |
|---|---|---|---|---|---|---|---|---|---|---|---|---|---|
| 10 | V | 1300 | 8960 | 50 | 10 | 79610 | 36110 | 95.53 | 0.10 | 0.00 | 0.04 | 0.02 | 4.31 |
| 11 | V | 1300 | 8960 | 50 | 10 | 15320 | 6950 | 95.53 | 0.10 | 0.00 | 0.04 | 0.02 | 4.31 |
| 12 | V | 1300 | 8960 | 50 | 10 | 64290 | 29160 | 95.53 | 0.10 | 0.00 | 0.04 | 0.02 | 4.31 |
| 14 | V | 1290 | 8890 | −28 | −33 | 64290 | 29160 | 95.53 | 0.10 | 0.00 | 0.04 | 0.02 | 4.31 |
| 15 | V | 1290 | 8890 | −28 | −33 | 79610 | 36110 | 95.53 | 0.10 | 0.00 | 0.04 | 0.02 | 4.31 |
| 16 | V | 455 | 3140 | −130 | −90 | 86200 | 39100 | 95.72 | 0.09 | 0.00 | 0.04 | 0.02 | 4.13 |
| 17 | V | 445 | 3070 | −130 | −90 | 6590 | 2990 | 98.00 | 0.00 | 0.00 | 0.00 | 0.00 | 2.00 |
| 18 | V | 455 | 3140 | −128 | −89 | 6590 | 2990 | 98.00 | 0.00 | 0.00 | 0.00 | 0.00 | 2.00 |
| 19 | V/L | 455 | 3140 | −153 | −103 | 118600 | 53780 | 80.35 | 0.00 | 0.00 | 0.00 | 0.02 | 19.63 |
| 20 | L | 455 | 3140 | −140 | −95 | 78640 | 35670 | 99.36 | 0.10 | 0.00 | 0.04 | 0.00 | 0.50 |
| 21 | V/L | 455 | 3140 | −171 | −113 | 118600 | 53780 | 80.35 | 0.00 | 0.00 | 0.00 | 0.02 | 19.63 |
| 22 | L | 455 | 3140 | −171 | −113 | 111040 | 50751 | 81.88 | 0.00 | 0.00 | 0.00 | 0.01 | 18.11 |
| 23 | V | 455 | 3140 | −171 | −113 | 7560 | 3430 | 57.83 | 0.00 | 0.00 | 0.00 | 0.21 | 41.96 |
| 24 | V | 445 | 3070 | 40 | 4 | 7560 | 3430 | 57.83 | 0.00 | 0.00 | 0.00 | 0.21 | 41.96 |

Power

| | | Power, kW | Power, hp |
|---|---|---|---|
| Refrigeration System 36 | | 125,760 | 168,650 |
| Compressor 38 | | 25 | 30 |
| | Subtotal | 125,785 | 168,850 |
| Expander 33 | | −8510 | −11410 |
| | Total | 117,275 | 157,440 |

What is claimed is:

1. A process for producing pressurized liquefied natural gas that is lean in a component more volatile than methane from a natural gas feed stream containing the more volatile component, comprising the steps of:

(a) passing the feed stream to a fractionation system to produce a first liquid lean in the volatile component and a first vapor of enhanced volatile component content;

(b) cooling the first vapor to produce a vapor phase and a liquid phase;

(c) phase separating the vapor phase and liquid phase of step (b) to produce a second vapor stream and a second liquid stream;

(d) returning the second liquid stream to the fractionation system as reflux; and (e) removing from the fractionation system the first liquid as a liquid product stream lean in the volatile component and having a temperature above about −112° C. (−170° F.) and a pressure sufficient for the liquid product to be at or below its bubble point.

2. The process of claim 1 wherein the volatile component is nitrogen.

3. The process of claim 1 wherein the volatile component is helium.

4. The process of claim 1 wherein prior to introducing the feed stream to the fractionation system, introducing to the feed stream a boil-off gas resulting from evaporation of a liquefied natural gas.

5. The process of claim 1 wherein prior to introducing the feed stream to the fractionation system, expanding the feed stream to reduce its temperature and pressure.

6. The process of claim 5 wherein the feed stream has a pressure above about 4,137 kPa (600 psia).

7. The process of claim 1 wherein the process further comprises the step of using the second vapor stream to cool the feed stream prior to step (a).

8. The process of claim 1 wherein the nitrogen content of the feed stream ranges between about 1 and about 15 mole percent nitrogen.

9. A process for producing pressurized liquefied natural gas that is lean in a component more volatile than methane from a natural gas feed stream containing the more volatile component, comprising the steps of:

(a) cooling one part of the natural gas feed stream by indirect heat exchange with a process-derived vapor stream from a fractionation system;

(b) cooling a second part of the natural gas feed stream by indirect heat exchange with a process-derived liquid stream from the fractionation system;

(c) combining the cooled feed streams of steps (a) and (b);

(d) expanding the combined feed stream to reduce its temperature and pressure;

(e) passing the expanded feed stream to the fractionation system to produce a first liquid stream lean in the volatile component and a first vapor stream of enhanced volatile component content;

(f) cooling the first vapor stream to produce a vapor phase and a liquid phase;

(g) phase separating the vapor phase and liquid phase of step (f) to produce a second vapor stream and a second liquid stream;

(h) returning the second liquid stream to the fractionation system as reflux;

(i) using the second vapor stream to cool the feed stream in step (a); and (j) removing from the fractionation system the first liquid as a product stream lean in the volatile component and having a temperature above about −112° C. (−170° F.) and a pressure sufficient for the liquid product to be at or below its bubble point.

* * * * *